United States Patent [19]

Murata

[11] 4,407,263

[45] Oct. 4, 1983

[54] CUTTING BLADE

[75] Inventor: Yasunori Murata, Nara, Japan

[73] Assignee: Diamond Giken Co., Ltd., Tokyo, Japan

[21] Appl. No.: 248,338

[22] Filed: Mar. 27, 1981

[51] Int. Cl.³ ..... B28D 1/04

[52] U.S. Cl. ..... 125/15; 51/206 R

[58] Field of Search ..... 125/15, 18; 51/206 R

[56] References Cited

U.S. PATENT DOCUMENTS

| | | | |
|---|---|---|---|
| 2,811,960 | 11/1957 | Fessel | 125/15 |
| 3,049,843 | 8/1962 | Christensen | 125/15 |
| 3,110,579 | 11/1963 | Benson | 125/15 |
| 3,127,887 | 4/1964 | Metzger | 125/15 |
| 3,205,624 | 9/1965 | Weiss | 125/15 |
| 3,491,742 | 1/1970 | Weiss | 125/15 |

*Primary Examiner*—Harold D. Whitehead

*Attorney, Agent, or Firm*—Armstrong, Nikaido, Marmelstein & Kubovcik

[57] ABSTRACT

An improved cutting blade for use in cutting hard but brittle materials is proposed. It has a base plate, both sides of which are formed with a plurality of grooves. Abrasive grains are affixed to the blade in these grooves in such a manner that these abrasive grains will project partially beyond the surface of the base plate.

13 Claims, 14 Drawing Figures

CUTTING BLADE

BACKGROUND OF THE INVENTION

The present invention relates to a cutting blade, and more particularly to a cutting blade for use in cutting hard but brittle materials such as semiconductors (e.g., silicon and germanium), quartz, ferrite and glass.

A drastic development of the electronic industry in recent years has produced the need of miniaturized electronic devices or parts in large quantities. Generally, for the production of electronic parts, a large mass of the material is cut to pieces and then ground, lapped and further worked into minute parts. The cost for manufacturing electronic parts is greatly affected by the speed and accuracy with which the material is cut and by the amount of the material loss in cutting.

In the conventional cutting process, a large mass of material is trimmed into a suitable shape and then sliced with a thin cutting wheel having abrasive grains of diamond, cubic boron nitride (CBN) or the like affixed to its surfaces. Various cutting blades are used which include peripheral cutting edge blades, ID blades (inside diameter blades), reciprocating steel band blades and high-speed endless band saws. In view of the fact that the materials to be sliced for producing electronic parts are generally expensive and of high grade and have to be cut into very thin pieces, a cutting blade should be as thin as possible to minimize the cutting material loss and thereby reduce the manufacturing cost.

A peripheral cutting edge blade is a disk, to the outer periphery of which abrasive grains are secured. In cutting, the disk is rotated at a high speed. Although a thinner blade can be obtained by using a thinner disk, this will lower the rigidity of the blade and make the blade liable to deflect due to the resistance with which it meets during cutting operation. Deflection of the blade is a hindrance to an accurate cutting especially in case a large mass of material is to be cut.

An ID blade, which is most suitable for slicing, is a thin disk having a center hole. Grains of diamond, etc. are secured by electrodeposition to the inner edge of the center hole. The ID blade is strained for higher rigidity in the same manner as when a skin is stretched over either end of a drum. For cutting operation, the ID blade is subjected to a high-speed revolution.

Among the reciprocating steel band blades, there are two types, i.e., fixed grain type and loose grain type. In either of the blades, a thin steel band is stretched and subjected to reciprocating motion for cutting. A high-speed endless band saw includes a steel band having the ends joined together and is tightly stretched around two pulleys and rotated at a high speed. Grains of diamond are affixed to the underside of the steel band.

In order to obtain a thin blade, electrodeposition is a prevalent way of affixing abrasive grains to the surfaces of an ID blade, fixed grain type reciprocating band blade and high-speed endless band saw. This is because electrodeposition does not include any heating process such as sintering or brazing which can cause deflection of a thin base plate. Being typical of thin cutting blades for slicing and in general use for slicing a mass of silicon, an ID blade poses the following problems:

FIG. 1 is a sectional view of a conventional cutting blade to which abrasive grains are secured by electrodeposition. In case of an ID blade, a thin base plate 1 is made of stainless steel with a thickness of approximately 0.1 mm. Grains 2 of diamond, etc. are bonded to the base plate 1 through nickel bond 3 by electrodeposition. Since the grains 2 are bonded only in a single layer, the life of such a cutting blade runs out as soon as the grains 2 at the inner end get worn out or crush. Consequently cutting blades have to be replaced frequently for a given amount of work. As for the size of abrasive grains, it is evident that the coarser the grains are, the higher cutting speed can be obtained and the longer life the cutting blade has. On the other hand, the coarser the grains are, the larger the material loss is because the thickness of the cutting blade is the thickness of the base plate 1 plus twice the diameter of the abrasive grain 2. Also, the coarser the grains are, the more rugged the surface finish. In view of such factors, the conventional ID blades are normally provided with grains of diamond of 270 to 400 mesh, which are equivalent to 40 to 80 microns in diameter, and have a total blade thickness of 0.23 to 0.28 mm.

The second problem posed by the conventional ID blade is that because abrasive grains are bonded in a single layer to the inner edge of the center hole, the ID blade must be carefully centered when it is mounted on a slicing machine. Unlike metal- or resin-bonded wheels to which a thick layer of abrasive grains is bonded, the ID blade cannot be trued for accurate alignment once it has been mounted on a cutter. This alignment requires a great deal of skill and time.

In order to eliminate the above-described drawbacks, some of the ID blades have abrasive grains bonded in multilayers to the inner edges as shown in FIG. 2.

Even in this type of ID blades, however, abrasive grains are bonded in four or five layers at most. In addition, cutting blades having abrasive grains affixed by electrodeposition has an extremely higher density of abrasive grains than in metal- or resin-bonded blades. This poses a large disadvantage for blades having grades in multilayers. The cutting load applied on each abrasive grain is smaller so that the degree of what is called "the self-sharpening action", i.e., an action of keeping themselves sharp by being crushed in the course of cutting operation, will be less. In addition, because of small distances between the abrasive grains, the wear of the bond is less so that the abrasive grains will project less from the surface of the bond. This causes poor chip ejection and a short supply of cutting oil. Thus, the wheel is more likely to get loaded and requires frequent dressing to maintain the cutting accuracy. Therefore, it is difficult to adapt such an ID blade to an automatic cutting machine.

SUMMARY OF THE INVENTION

It is an object of the present invention to provide a thin and sharp cutting blade which eliminates the above-described disadvantages and which has a longer life and is easy to handle.

It is another object of the present invention to provide a cutting blade which has abrasive grains bonded to the base plate with greater bonding strength.

In accordance with the present invention, there is provided a cutting blade having a base plate formed with a plurality of grooves in both sides thereof and abrasive grains bonded to the cutting blade in the grooves.

With the above-described object in view and as will become apparent from the following detailed description, the present invention will be more clearly understood in connection with the accompanying drawings.

DETAILED DESCRIPTION OF THE INVENTION

Figure 3:
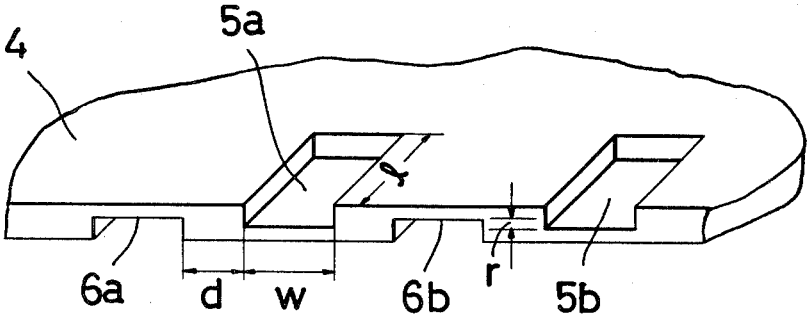
FIG. 3 is a partial perspective view of the base plate of a cutting blade of the present invention.

Referring now to FIG. 3, the cutting blade of the present invention includes a base plate 4. Grooves 5*a*, 5*b*, . . . are formed in the upper surface of the base plate and grooves 6*a*, 6*b*, . . . are formed in the lower surface thereof in such a manner that the former alternate with the latter. The depth of these grooves should be 50% or more, preferably 75%, of the thickness of the base plate 4, but it should not be so deep as to render it impossible to maintain the strength of the base plate 4. These grooves may be formed by photoetching or electric discharge machining. If the depth of these grooves is more than 50% of the thickness of the base plate 4, this means that there is some distance, r, where the grooves 5*a*, 5*b* overlap the grooves 6*a*, 6*b*.

The width W and the length l of each groove may be decided freely. The space d between the adjacent grooves should be decided in due consideration of the strength of the base plate 4.

Figure 4:
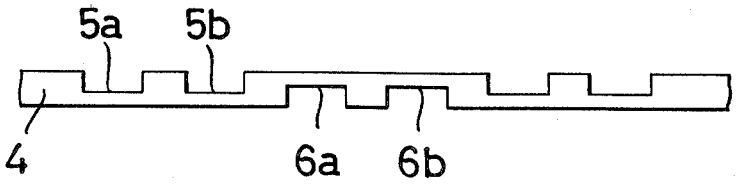
FIG. 4 is a partial end view of another example of the base plates.

Although each groove formed in the upper surface of the base plate alternates with each groove formed in the lower surface thereof in FIG. 3, every two grooves formed in the upper surface may alternate with every two grooves formed in the lower surface as shown in FIG. 4. The point is that the grooves should be equally and uniformly formed in the upper surface in relation to those formed in the lower surface.

Figure 5:
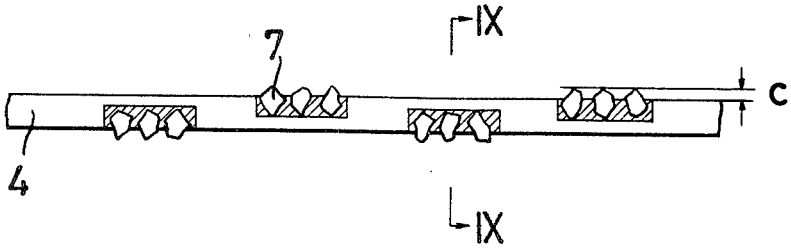
FIGS. 5 to 8 are sectional views of preferred embodiments of the present invention.

Referring now to FIG. 5, abrasive grains 7 somewhat larger than the depth of the grooves are bonded to the grooves by electrodeposition so that each grain 7 will project by distance c beyond the surface of the base plate to keep the surfaces of the base plate out of contact with the object to be cut during cutting operation, and to assure smooth chip ejection and cutting oil supply.

Figure 6:
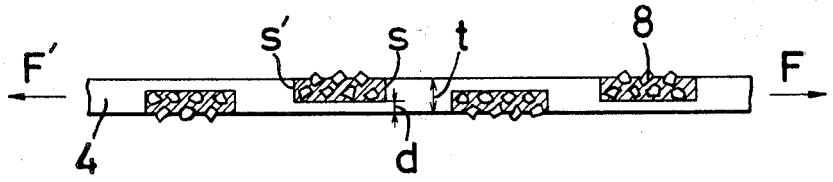

Referring now to FIG. 6, abrasive grains 8 having a grain size smaller than the depth of the grooves are bonded in several layers to the grooves by electrodeposition. Some of the grains 8 constituting the outermost layer projects beyond the surface of the base plate 4.

Figure 7:
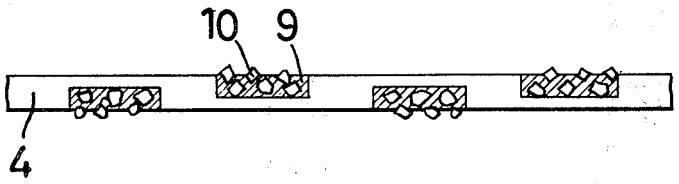

FIG. 7 shows another preferred embodiment of the present invention. First, abrasive grains 9 having a grain size smaller than the depth of the grooves are electrodeposited in the grooves. Then, abrasive grains 10 having a grain size smaller than the abrasive grains 9 are electrodeposited over the abrasive grains 9 so that the grains 10 will project beyond the surface of the base plate 4. The surface finish becomes less rugged thanks to the smaller grain size of the abrasive grains 10.

Figure 8:
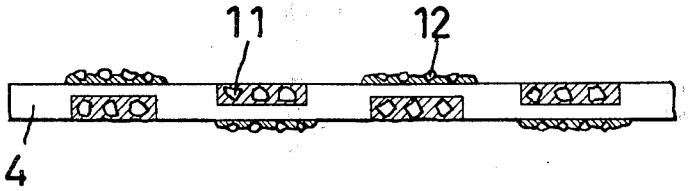

FIG. 8 shows still another preferred embodiment of the present invention. Abrasive grains 11 having a grain size approximate to the depth of the grooves are electrodeposited to the grooves so as to allow the abrasive grains 11 to nearly appear at the surfaces of the base plate 4. On the other hand, smaller abrasive grains 12 are bonded to the portions of each surface of the base plate which lie midway between the adjacent grooves, in order to keep the surfaces of the base plate out of contact with the object to be cut and thus to improve the appearance of the surface of the workpiece.

When using any of the cutting blades according to the present invention, a considerable amount of tension is applied to the cutting blade in the direction F—F′ (FIG. 6) to provide a sufficient rigidity at the blade edge for accurate, efficient cutting and to prevent the blade from deflecting under the cutting resistance. The larger the tension, the better cutting performance can be expected. For ID blades, for example, tension is normally increased just before the limit at which the base plate breaks.

In case nickel is used as the bond in the embodiment of e.g. FIG. 6, if excess tension is applied, the electrodeposited nickel bond is likely to peel off the base plate at the sides S, S′ of each groove. As a result, the base plate will have a smaller effective thickness d in relation to the original thickness t of the base plate. The base plate becomes likely to break at such a thinner portion. This makes it prohibitive to apply a sufficient tension. For the above-mentioned reason, it is very important to give a high bonding strength to the bond between the base plate and the bond layer.

Figure 10:
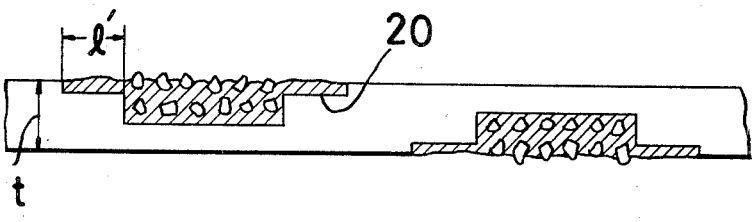
FIGS. 10 to 12 are sectional views of further embodiments.

Referring to FIG. 10 illustrating a further embodiment, a cutting blade has a base plate formed with a plurality of grooves 20 on both sides thereof, said grooves having a deep portion of a depth equal to at least 50% of the thickness of the base plate and a pair of shallow leg portions of smaller depth than 50% of its thickness at each side of the deep portion. Abrasive grains are bonded in each of the grooves at their deep portions. The addition of such shallow groove portions increases the area of contact between the bond and the base plate and thus the bonding strength. This enables the cutting blade to resist a greater tension than before.

The width and depth of each shallow groove portion can be determined in consideration of the tensile strength of the bond. The shallow groove portion should preferably have a rugged bottom rather than a flat bottom to ensure high bonding strength. It may take any other section as in the embodiments of FIGS. 11 and 12.

Figure 11:
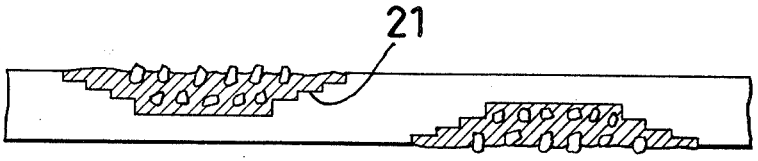

Referring to FIG. 11, a cutting blade has a base plate formed with a plurality of grooves 21 having step-like sides tapering toward the surface of the base plate. This embodiment provides a higher bonding strength than the embodiment of FIG. 10.

Figure 12:
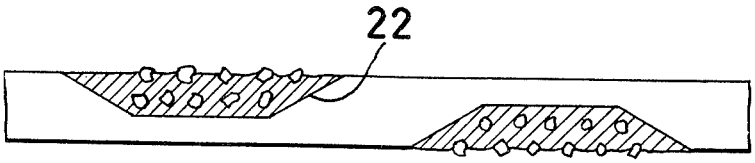

Referring to FIG. 12, a cutting blade has a base plate formed with a plurality of grooves 22 of a trapezoidal section with their sides tapering toward the surface of the base plate. Infinitely increasing the number of steps in the embodiment of FIG. 11 would result in the embodiment of FIG. 12.

Figure 13:
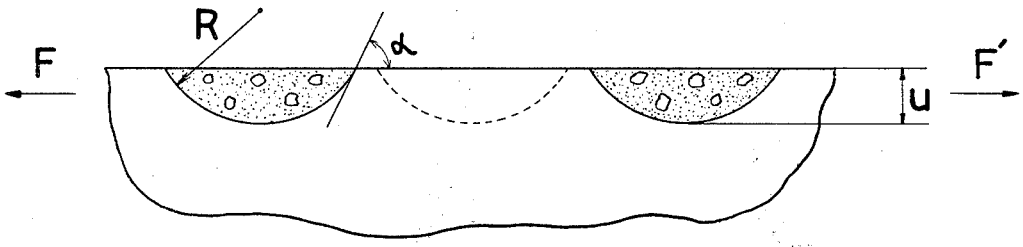
FIGS. 13 and 14 are top views of further embodiments.

Referring to FIG. 13 which is a top view of further embodiment of this invention, the cutting blade has a plurality of grooves in both sides thereof, said grooves being of a semi-circular or basin-like shape as viewed from top, rather than a rectangular shape as in the above-described embodiments. The larger the radius of curvature R and the smaller the width u of the groove and the smaller the angle $\alpha$ with respect to the edge of the cutting blade, the less the possibility of the bond layer peeling off the base plate will be when the cutting blade is subjected to a tensile force from directions F, F'.

Figure 14:
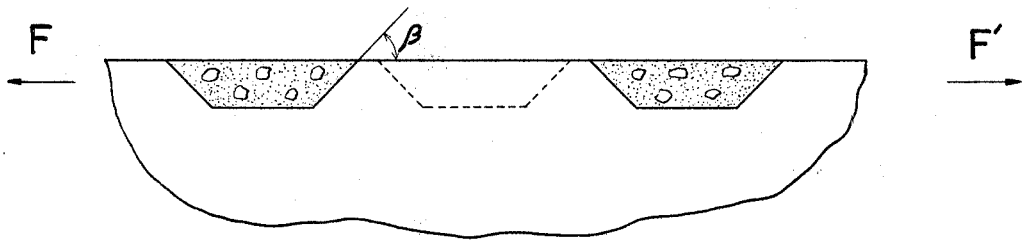

Similarly, the embodiment of FIG. 14 has a plurality of grooves of a trapezoidal shape as viewed from top. The smaller the angle $\beta$ with respect to the blade edge, the less the peeling possibility will be.

Generally, if two bar-like parts are bonded end to end, the bonding surface should be oblique to the axis of these two parts, rather than perpendicular, to increase the bonding area, thereby assuring high bonding strength. For this reason, the embodiments of FIGS. 13 and 14 provide higher bonding strength than the embodiments having grooves of a rectangular shape as viewed from top.

Figure 1:
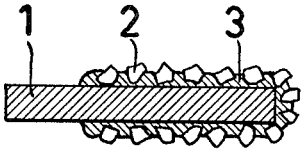
FIG.1 PRIOR ART
FIG. 1 is a sectional view of conventional cutting blades.
Figure 2:
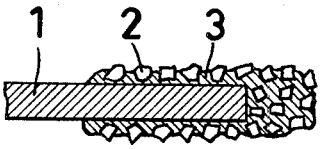
FIG.2 PRIOR ART
FIG. 2 is a similar view of another conventional cutting blade.
Figure 9:
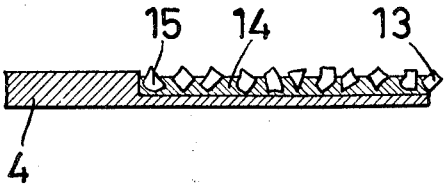
FIG. 9 is an enlarged sectional view taken along the line IX—IX of FIG. 5.

The cutting blade of the present invention has the following advantages:

(1) The conventional cutting blade having grains electrodeposited has only a short life because it is provided with only one to five abrasive grains at its edge as shown in FIGS. 1 and 2. In contrast the cutting blade of the present invention has a much longer life because it can be used until all the abrasive grains embedded in the base plate are worn out to the last grain 15 (FIG. 9).

(2) Because the abrasive grains are embedded in the base plate, the total thickness of the cutting blade can be minimized even when large-sized abrasive grains are used. This also minimizes the material loss in cutting and allows high cutting speed to be used.

(3) Good chip ejection and cutting oil supply are assured because of larger opening left between the surfaces of the base plate and the workpiece and because the surface of the abrasive grains makes discontinuous contact with the surface of the workpiece. Therefore, the workpiece hardly runs hot at the cutting point and is hardly warped. This assures high cutting accuracy, minimizes heat-affected zone and loading and allows high-speed cutting.

(4) As shown in FIGS. 7 and 8, the cutting blade of the present invention can be provided with abrasive grains of different sizes allotted for different purposes. The coarser grains 9 and 11, which are located in the depth of the grooves, participate mainly in the attainment of high cutting efficiency. The cut surface of the material is ground and the surface finish is improved by the small-sized abrasive grains 10 and 12 provided on the surface of the base plate. Thus, both of higher cutting speed and better surface finish are obtained.

(5) The degree of ease with which the abrasive grain 13 provided at the right-hand end of the base plate in FIG. 9 is allowed to fall off can be adjusted by changing the thickness of the bond 14 by which the abrasive grains are bonded to the groove. This means that the self-sharpening action of the cutting blade can be adjusted and that truing and dressing of the cutting blade are easy.

(6) Even when the cutting blade of the present invention takes the form of an ID blade, it can be easily trued and dressed after it has been mounted on a slicing machine. Therefore, one need not take care for accurate alignment when mounting it on a cutter.

Although the preferred embodiments take the form of an ID blade, the present invention can also be applied to a peripheral cutting edge blade, fixed grain type reciprocating band blade, high-speed endless band saw, etc.

While a few embodiments of the present invention have been disclosed, it is to be understood that they have been described by way of examples only, various other modifications being obvious.

What I claim is:

1. A cutting blade comprising a base plate formed with a plurality of grooves in both sides thereof, said grooves having a depth being at least half of the thickness of said base plate, abrasive grains affixed to said base plate in said grooves and further grains affixed to the surface of the base plate at spaced locations midway of each pair of adjoining grooves in both sides of the base plate.

2. A cutting blade as set forth in claim 1, wherein said grooves are formed so that each groove formed in the upper surface of said base plate alternates with each groove formed in the lower surface thereof.

3. A cutting blade as set forth in claim 1, wherein said grooves are formed so that every two grooves formed in the upper surface of said base plate alternate with every two grooves formed in the lower surface thereof.

4. A cutting blade as set forth in claim 1, wherein the depth of said grooves is approximately 75% of the thickness of said base plate.

5. A cutting blade as set forth in claim 1, wherein said abrasive grains are affixed in a single layer to said base plate in said grooves.

6. A cutting blade as set forth in claim 1, wherein said abrasive grains are affixed in two or more layers to said base plate in said grooves so that the grains constituting the outermost layer projects beyond the surface of said plate.

7. A cutting blade as set forth in claim 6, wherein the abrasive grains in the upper layer have a grain size smaller than the abrasive grains in the lower layer.

8. A cutting blade as set forth in claim 1, wherein said grooves are of a rectangular section.

9. A cutting blade as set forth in claim 1, wherein said grooves have a deep portion and a pair of shallow leg portions.

10. A cutting blade as set forth in claim 1, wherein said grooves are of a trapezoidal section.

11. A cutting blade as set forth in claim 1, wherein said grooves are of a trapezoidal section and have step-like sides.

12. A cutting blade as set forth in claim 1, wherein said grooves are of a semi-circular shape as viewed from top.

13. A cutting blade as set forth in claim 1, wherein said grooves are of a trapezoidal shape as viewed from top.

* * * * *